US008646192B2

(12) United States Patent
Berton

(10) Patent No.: US 8,646,192 B2
(45) Date of Patent: Feb. 11, 2014

(54) COMPOSITE TOOTH FOR WORKING THE GROUND OR ROCK

(75) Inventor: Guy Berton, Oteppe (BE)

(73) Assignee: Magotteaux International S.A., Vaux-sous-Chevremont (BE)

( * ) Notice: Subject to any disclaimer, the term of this patent is extended or adjusted under 35 U.S.C. 154(b) by 370 days.

(21) Appl. No.: 13/119,669

(22) PCT Filed: Aug. 26, 2009

(86) PCT No.: PCT/EP2009/060978
§ 371 (c)(1),
(2), (4) Date: May 31, 2011

(87) PCT Pub. No.: WO2010/031660
PCT Pub. Date: Mar. 25, 2010

(65) Prior Publication Data

US 2011/0225856 A1 Sep. 22, 2011

(30) Foreign Application Priority Data

Sep. 19, 2008 (BE) ..... 2008/0518

(51) Int. Cl.
*E02F 3/00* (2006.01)

(52) U.S. Cl.
USPC ..... 37/460

(58) Field of Classification Search
USPC ..... 37/446, 452–460; 172/701.1–701.3; 75/317, 320, 504, 770, 351, 368; 148/325–327, 419, 430, 400, 405, 515; 420/35, 43, 468, 584.1, 586.1; 623/1.15; 427/450, 452, 455, 249.1, 427/249.2, 249.9, 189
See application file for complete search history.

(56) References Cited

U.S. PATENT DOCUMENTS

| | | | | |
|---|---|---|---|---|
| 5,081,774 | A | 1/1992 | Kuwano | |
| 5,337,801 | A | 8/1994 | Materkowski | |
| 5,720,830 | A | 2/1998 | Wragg et al. | |
| 6,139,658 | A * | 10/2000 | Davies et al. | 148/515 |
| 6,607,782 | B1 * | 8/2003 | Malshe et al. | 427/189 |
| 7,780,798 | B2 * | 8/2010 | Stinson et al. | 148/326 |
| 7,842,119 | B2 * | 11/2010 | Muramatsu et al. | 75/317 |

FOREIGN PATENT DOCUMENTS

EP 1450973 B1 9/2002

OTHER PUBLICATIONS

K. Das, A Review on the various synthesis routes of TiC reinforced ferrous based composites, online publication, 2002, 11 pages, pp. 3881-3892 , Journal of Materials Science 37 (2002) 3881-3892.

* cited by examiner

*Primary Examiner* — Robert Pezzuto
(74) *Attorney, Agent, or Firm* — Reinhart Boerner Van Deuren P.C.

(57) ABSTRACT

The present invention discloses a composite tooth for working the ground or rocks, said tooth comprising a ferrous alloy at least partially reinforced with titanium carbide according to a defined geometry, in which said reinforced portion comprises an alternating macro-microstructure of millimetric areas concentrated with micrometric globular particles of titanium carbide separated by millimetric areas essentially free of micrometric globular particles of titanium carbide, said areas concentrated with micrometric globular particles of titanium carbide forming a microstructure in which the micrometric interstices between said globular particles are also filled by said ferrous alloy.

13 Claims, 8 Drawing Sheets

COMPOSITE TOOTH FOR WORKING THE GROUND OR ROCK

FIELD OF THE INVENTION

The present invention relates to a composite tooth intended to equip a machine for working the ground or rocks. It relates in particular to a tooth having a metal matrix reinforced by particles of titanium carbide.

DEFINITION

The expression "tooth" should be interpreted in the broad sense and comprises any element of any dimension, having a pointed or flat shape, intended in particular to work the ground, the bottom of rivers or seas, rocks, in the open or in mines.

STATE OF THE ART

Few means are known for modifying the hardness and impact resistance of a foundry alloy in depth "in the mass." The known means generally concern surface modifications at a small depth (a few mm). For teeth made in foundries, the reinforcement elements must be present in depth in order to withstand significant and simultaneous localized stresses in terms of mechanical stresses, wear and impact, and also because a tooth is used over a large portion of its length.

Recharging the teeth with metal carbides (Technosphere®-Technogenia) by oxyacetylenic welding is well-known. Such recharging allows to deposit a layer of carbide of a thickness of several millimeters on the surface of a tooth. Such reinforcement is however not integrated into the metal matrix of the tooth and does not guarantee the same performance as a tooth where a carbide reinforcement is completely incorporated into the mass of the metal matrix.

Document EP 1 450 973 B1 describes a reinforcement of the wear parts made by placing, in the mold intended to receive the cast metal, an insert formed by reactive powders that react with each other thanks to the heat provided by the metal during casting at a very high temperature (>1400° C.). After a reaction of the SHS type, the powders of the reactive insert will create a relatively uniform porous cluster (conglomerate) of hard particles; once formed, this porous cluster will be immediately infiltrated by the cast metal at a high temperature. The reaction of the powders is exothermic and self-propagating, which allows a synthesis of the carbides at a high temperature and considerably increases the wettability of the porous cluster by the infiltration metal.

Document U.S. Pat. No. 5,081,774 discloses different ways of positioning, in a flat tooth, inserts made from chromium cast iron intended to increase the performance thereof. But it is known that the limitations of such a technique are on one hand the large mass of the reinforcement, which tends to make the part brittle, and on the other hand the insufficient bond (welding) between the inserts and the base metal of the part.

Document U.S. Pat. No. 5,337,801 (Materkowski) discloses another method for depositing hard particles of tungsten carbide on the working surface of the teeth. In this case steel inserts containing hard particles are first prepared; those inserts are then positioned in the mold, then are incorporated into the cast base metal to make the part. This procedure is long and costly, does not exclude a possible reaction between the tungsten carbide and the metal of the inserts and does not always guarantee perfect welding of the hard particles to the base metal.

AIMS OF THE INVENTION

The present invention discloses a composite tooth for a tool for working the ground or rock, in particular for excavation or sludging tools, with an improved resistance to wear while also maintaining a good resistance to impacts. This property is obtained by a composite reinforcement structure specifically designed for this application, a material which at a millimetric scale alternates areas which are dense with fine micrometric globular particles of metal carbides with areas which are practically free of them within the metal matrix of the tooth.

The present invention also proposes a method for obtaining said reinforcement structure.

SUMMARY OF THE INVENTION

The present invention provides for a composite tooth for working the ground or rocks, the tooth comprising a ferrous alloy reinforced at least partially with titanium carbide according to a defined geometry, in which the reinforced portion comprises an alternating macro-microstructure of millimetric areas concentrated with micrometric globular particles of titanium carbide separated by millimetric areas essentially free of micrometric globular particles of titanium carbide. The areas are concentrated with micrometric globular particles of titanium carbide forming a microstructure in which the micrometric interstices between the globular particles are also filled by the ferrous alloy.

According to particular embodiments of the invention, the composite tooth comprises at least one or one suitable combination of the following features:

- said concentrated millimetric areas have a titanium carbide concentration of more than 36.9% by volume;
- said reinforced portion has a global titanium carbide content between 16.6 and 50.5% by volume;
- the micrometric globular particles of titanium carbide have a size of less than 50 μm;
- the major portion of the micrometric globular particles of titanium carbide has a size of less than 20 μm;
- said areas concentrated with globular particles of titanium carbide comprise 36.9 to 72.2% by volume of titanium carbide;
- said millimetric areas concentrated with titanium carbide have a size varying from 1 to 12 mm;
- said millimetric areas concentrated with titanium carbide have a size varying from 1 to 6 mm;
- said areas concentrated with titanium carbide have a size varying from 1.4 to 4 mm.

The present invention also discloses a method for manufacturing the composite tooth according to any of claims 1 to 9 comprising the following steps:

- providing a mold comprising the imprint of the tooth with a predefined reinforcement geometry;
- introducing into the portion of the imprint of the tooth intended to form the reinforced portion (5) a mixture of compacted powders comprising carbon and titanium in the form of millimetric granules precursor of titanium carbide;
- casting a ferrous alloy into the mold, the heat of said casting triggering an exothermic self-propagating high temperature synthesis (SHS) of titanium carbide within said precursor granules;
- forming, within the reinforced portion of the composite tooth, an alternating macro-microstructure of millimetric areas concentrated with micrometric globular particles of titanium carbide at the location of said precursor granules, said areas being separated from each other by millimetric areas essentially free of micrometric globular particles of titanium carbide, said globular particles being also separated within said millimetric areas concentrated with titanium carbide through micrometric interstices;

infiltration of the millimetric and micrometric interstices by said high temperature cast ferrous alloy, following the formation of microscopic globular particles of titanium carbide.

According to particular embodiments of the invention, the method comprises at least one or one suitable combination of the following features:

the compacted powders of titanium and carbon comprise a powder of a ferrous alloy;

said carbon is graphite.

The present invention also discloses a composite tooth obtained according to the method of any of claims 11 to 13.

Figures 3A, 3B, 3C, 3D:
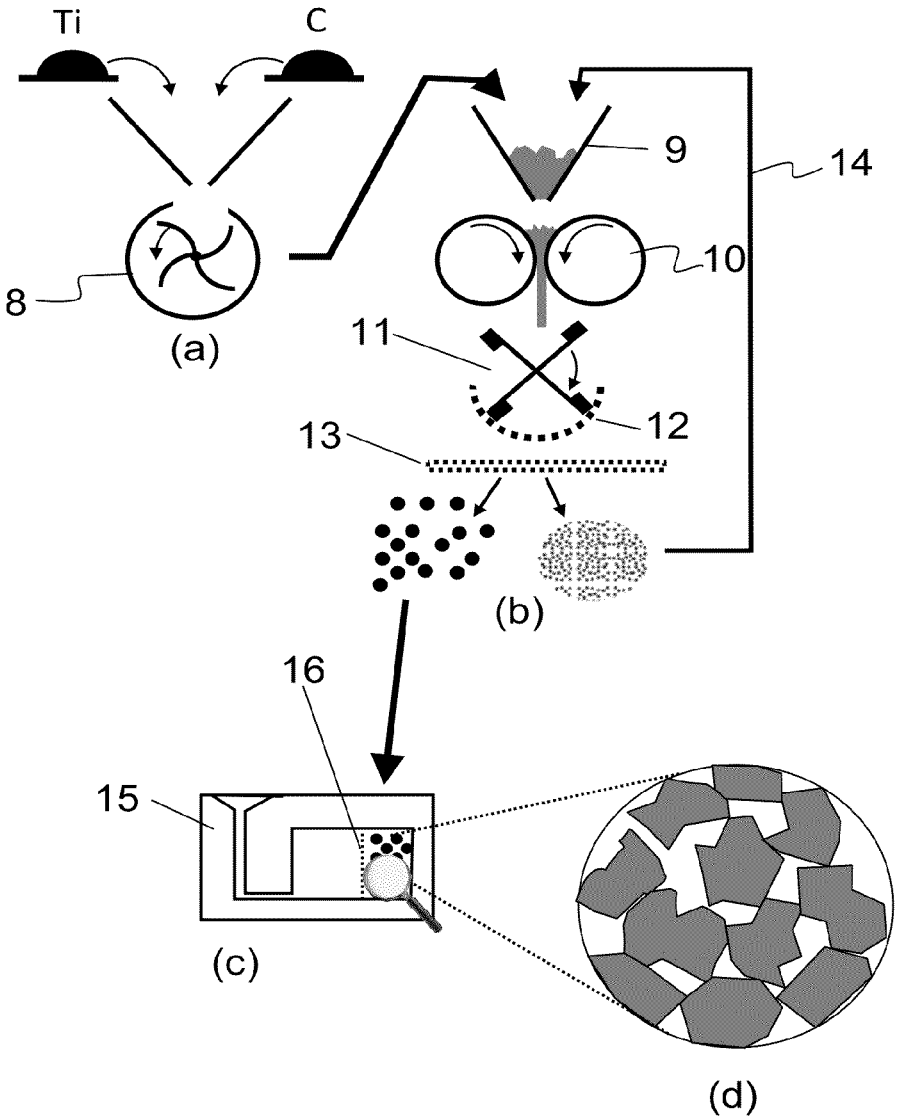
FIGS. 3*a*-3*h* illustrate the method for manufacturing the tooth represented in FIG. 1*b* according to the invention.

step 3*a* shows the device for mixing the titanium and carbon powders;

step 3*b* shows the compaction of the powders between two rolls followed by crushing and sifting with recycling of the too fine particles;

FIG. 3*c* shows a sand mold in which a barrier is placed for containing the granules of powder compacted at the location of the reinforcement of the tooth of the type 1*d;*

Figures 3E, 3F, 3G, 3H:
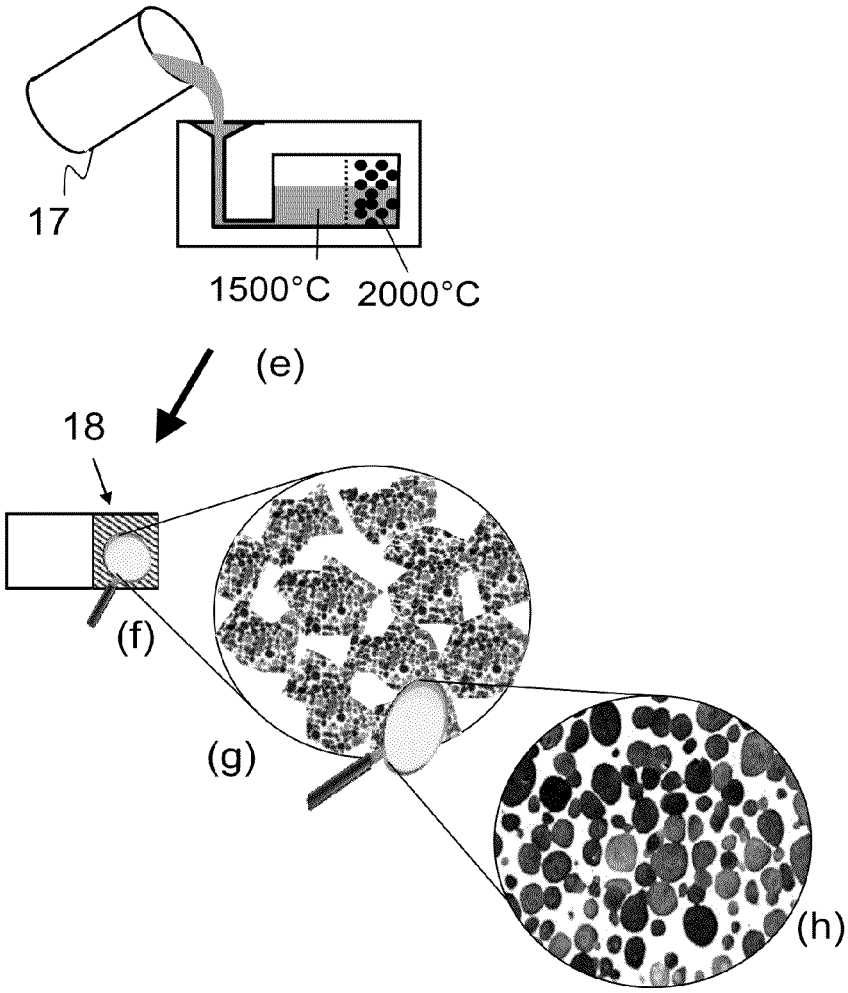
Figure 4:
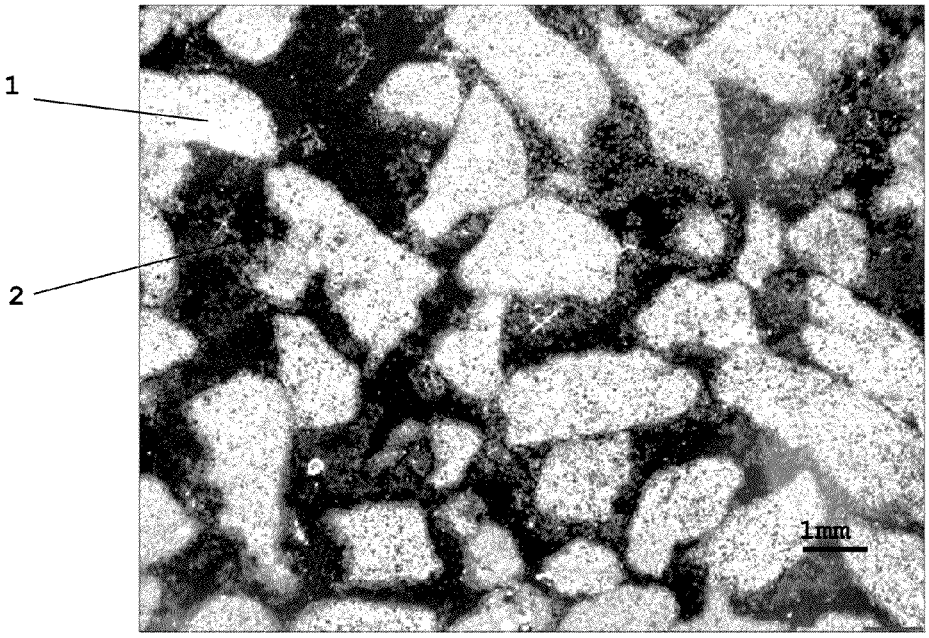

FIG. 3*d* shows an enlargement of the reinforcement area in which the compacted granules comprising the reagents precursor of TiC are located;

step 3*e* shows the casting of the ferrous alloy into the mold;

FIG. 3*f* shows the tooth of the type 1*b* which is the result of the casting;

FIG. 3*g* shows an enlargement of the areas with a high concentration of TiC nodules—this diagram illustrates the same areas as in FIG. 4;

FIG. 3*h* shows an enlargement within a same area with a high concentration of TiC globules—the micrometric globules are individually surrounded by the cast metal.

FIG. 4 shows a binocular view of a polished, non-etched surface of a section of the reinforced portion of the tooth according to the invention with millimetric areas (in pale grey) concentrated with micrometric globular titanium carbide (TiC globules). The dark portion illustrates the metal matrix (steel or cast iron) filling both the space between these areas concentrated with micrometric globular titanium carbide but also the spaces between the globules themselves (See FIGS. 5 and 6).

Figure 5:
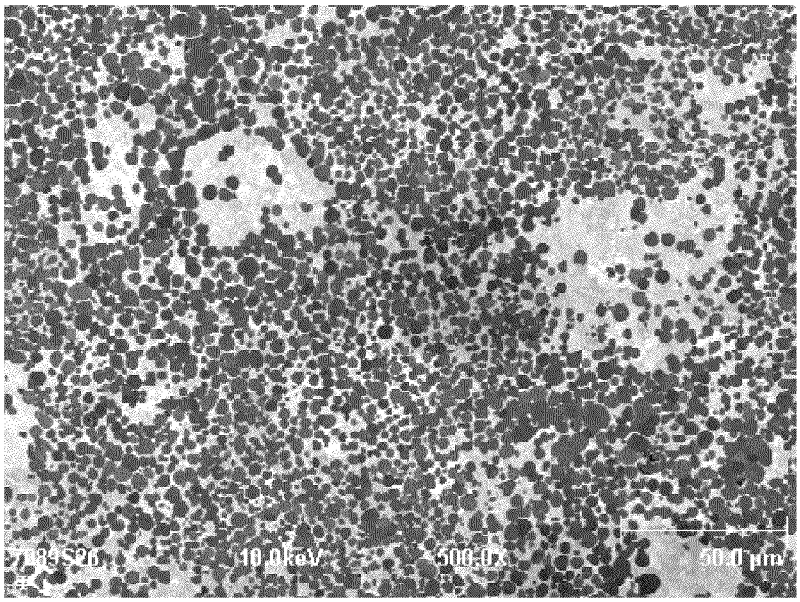
Figure 6:
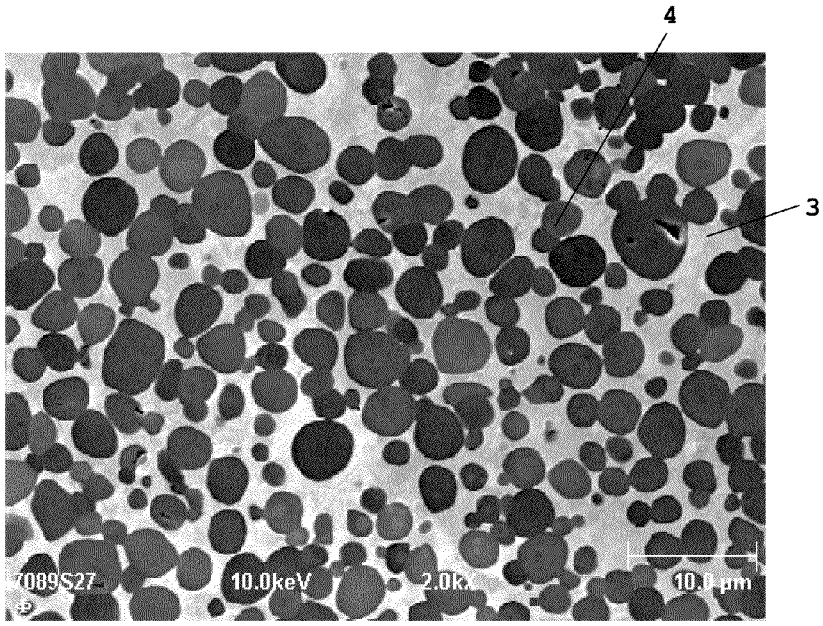

FIGS. 5 and 6 illustrate views taken with an SEM electron microscope of micrometric globular titanium carbide on polished and non-etched surfaces at different magnifications. It is seen that in this particular case, most of the titanium carbide globules have a size smaller than 10 μm.

Figure 7:
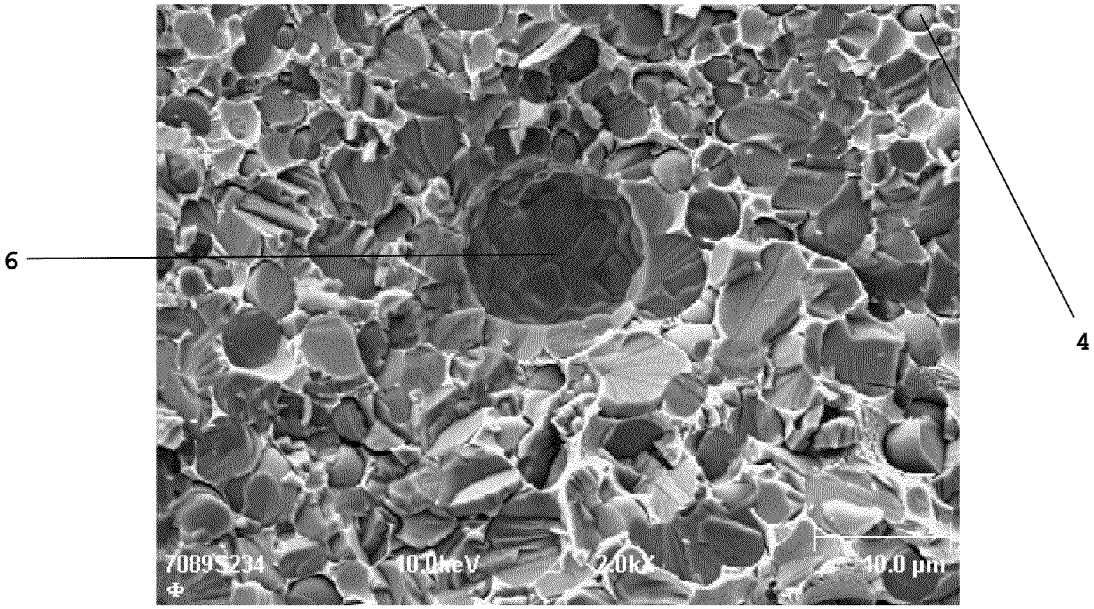

FIG. 7 illustrates a view of micrometric globular titanium carbide on a fracture surface taken with an SEM electron microscope. It is seen that the titanium carbide globules are perfectly incorporated into the metal matrix. This proves that the cast metal infiltrates (impregnates) completely the pores during the casting once the chemical reaction between titanium and carbon is initiated.

LEGEND

1. millimetric areas concentrated with micrometric globular particles (nodules) of titanium carbide (pale areas)
2. millimetric interstices filled with the cast ferrous alloy globally free from micrometric globular particles of titanium carbide (dark areas)
3. micrometric interstices between the TiC nodules also infiltrated with the cast alloy
4. micrometric globular titanium carbide, in the areas concentrated with titanium carbide
5. titanium carbide reinforcement
6. gas defects
7. (free)
8. Mixer of Ti and C powders
9. hopper
10. roller
11. crusher
12. run-out table
13. sieve
14. recycling of the too fine particles towards the hopper
15. sand mold
16. barrier containing the compacted granulates of Ti/C mixture
17. cast ladle
18. tooth of type 1*d*

DETAILED DESCRIPTION OF THE INVENTION

In materials science, a SHS reaction or <<Self-propagating High temperature Synthesis>> is a self-propagating high temperature synthesis where reaction temperatures generally above 1,500° C., or even 2,000° C. are reached. For example, the reaction between titanium powder and carbon powder in order to obtain titanium carbide TiC is strongly exothermic. Only a little energy is needed for locally initiating the reaction. Then, the reaction will spontaneously propagate to the totality of the mixture of the reagents by means of the high temperatures reached. After initiation of the reaction, a reaction front develops which thus propagates spontaneously (self-propagating) and which allows titanium carbide to be obtained from titanium and carbon. The thereby obtained titanium carbide is said to be <<obtained in situ>> because it does not stem from the cast ferrous alloy.

The mixtures of reagent powders comprise carbon powder and titanium powder and are compressed into plates and then crushed in order to obtain granules, the size of which varies from 1 to 12 mm, preferably from 1 to 6 mm, and more preferably from 1.4 to 4 mm. These granules are not 100% compacted. They are generally compressed to between 55 and 95% of the theoretical density. These granules allow an easy use/handling (see FIGS. 3*a*-3*h*)

These millimetric granules of mixed carbon and titanium powders obtained according to the diagrams of FIGS. 3*a*-3*h* are the precursors of the titanium carbide to be generated and allow portions of molds with various or irregular shapes to be easily filled. These granules may be maintained in place in the mold 15 by means of a barrier 16, for example. The shaping or the assembling of these granules may also be achieved with an adhesive.

The composite tooth for working the ground or rocks according to the present invention has a reinforcement macro-microstructure which may further be called an alternating structure of areas concentrated with globular micrometric particles of titanium carbide separated by areas which are practically free of them. Such a structure is obtained by the reaction in the mold 15 of the granules comprising a mixture of carbon and titanium powders. This reaction is initiated by the casting heat of the cast iron or the steel used for casting the whole part and therefore both the non-reinforced portion and the reinforced portion (see FIG. 3*e*). Casting therefore triggers an exothermic self-propagating high temperature synthesis of the mixture of carbon and titanium powders compacted as granules (self-propagating high temperature synthesis—SHS) and placed beforehand in the mold 15. The reaction then has the particularity of continuing to propagate as soon as it is initiated.

This high temperature synthesis (SHS) allows an easy infiltration of all the millimetric and micrometric interstices by the cast iron or cast steel (FIGS. 3*g* and 3*h*). By increasing the wettability, the infiltration may be achieved over any reinforcement thickness or depth of the tooth. After SHS reaction and an infiltration by an outer cast metal, it advantageously allows to generate one or more reinforcing areas on the tooth comprising a high concentration of micrometric globular particles of titanium carbide (which may further be called clusters of nodules), said areas having a size of the order of one millimeter or of a few millimeters, and which alternate with areas substantially free of globular titanium carbide.

Once these granules have reacted according to an SHS reaction, the reinforcement areas where these granules were located show a concentrated dispersion of micrometric globular particles 4 of TiC carbide (globules), the micrometric interstices 3 of which have also been infiltrated by the cast metal which here is cast iron or steel. It is important to note that the millimetric and micrometric interstices are infiltrated by the same metal matrix as the one which forms the non-reinforced portion of the tooth; this allows total freedom in the selection of the cast metal. In the finally obtained tooth, the reinforcement areas with a high concentration of titanium carbide consist of micrometric globular TiC particles in a significant percentage (between about 35 and about 70% by volume) and of the infiltration ferrous alloy.

By micrometric globular particles it is meant globally spheroidal particles which have a size ranging from 1 μm to a few tens of μm at the very most, the large majority of these particles having a size of less than 50 μm, and even less than 20 μm, or even 10 μm. We also call them TiC globules. This globular shape is characteristic of a method for obtaining titanium carbide by self-propagating synthesis SHS (see FIG. 6).

Obtaining Granules (Ti+C Version) for Reinforcing the Tooth

The method for obtaining the granules is illustrated in FIG. 3*a*-3*h*. The granules of carbon/titanium reagents are obtained by compaction between rolls 10 in order to obtain strips which are then crushed in a crusher 11. The mixing of the powders is carried out in a mixer 8 consisting of a tank provided with blades, in order to favor homogeneity. The mixture then passes into a granulation apparatus through a hopper 9. This machine comprises two rolls 10, through which the material is passed. Pressure is applied on these rolls 10, which allows the compression of the material. At the outlet a strip of compressed material is obtained which is then crushed in order to obtain the granules. These granules are then sifted to the desired grain size in a sieve 13. A significant parameter is the pressure applied on the rolls. The higher this pressure, the more the strip, and therefore the granules, will be compressed. The density of the strips, and therefore of the granules, may thus be varied between 55 and 95% of the theoretical density which is 3.75 g/cm$^3$ for the stoichiometric mixture of titanium and carbon. The apparent density (taking into account porosity) is then located between 2.06 and 3.56 g/cm$^3$.

The compaction level of the strips depends on the applied pressure (in Pa) on the rolls (diameter 200 mm, width 30 mm). For a low compaction level, of the order of $10^6$ Pa, a density on the strips of the order of 55% of the theoretical density is obtained. After passing through the rolls 10 in order to compress this material, the apparent density of the granules is 3.75×0.55, i.e. 2.06 g/cm$^3$.

For a high compaction level, of the order of $25.10^6$ Pa, a density on the strips of 90% of the theoretical density is obtained, i.e. an apparent density of 3.38 g/cm$^3$. In practice, it is possible to attain up to 95% of the theoretical density.

Therefore, the granules obtained from the raw material Ti+C are porous. This porosity varies from 5% for very highly compressed granules to 45% for slightly compressed granules.

In addition to the compaction level, it is also possible to adjust the grain size distribution of the granules as well as their shape during the operation of crushing the strips and sifting the Ti+C granules. The non-desired grain size fractions are recycled at will (see FIG. 3*b*). The obtained granules globally have a size between 1 and 12 mm, preferably between 1 and 6 mm, and more preferably between 1.4 and 4 mm.

Making of the Reinforcement Area in the Composite Tooth According to the Invention The granules are made as described above. In order to obtain a three-dimensional structure or a superstructure/macro-microstructure with these granules, they are positioned in the areas of the mold where it is desired to reinforce the part. This is achieved by agglomerating the granules either by means of an adhesive, or by confining them in a container or by any other means (barrier 16). The bulk density of the stack of the Ti+C granules is measured according to the ISO 697 standard and depends on the compaction level of the strips, on the grain size distribution of the granules and on the method for crushing the strips, which influences the shape of the granules.

The bulk density of these Ti+C granules is generally of the order of 0.9 g/cm$^3$ to 2.5 g/cm$^3$ depending on the compaction level of these granules and on the density of the stack.

Before reaction, there is therefore a stack of porous granules consisting of a mixture of titanium powder and carbon powder.

During the reaction Ti+C→TiC, a volume contraction of the order of 24% occurs, upon passing from the reagent to the product (a contraction originating from the density difference between the reagents and the products). Thus, the theoretical density of the Ti+C mixture is 3.75 g/cm$^3$ and the theoretical density of TiC is 4.93 g/cm$^3$. In the final product, after the reaction for obtaining TiC, the cast metal will infiltrate:

- the microscopic porosity present in the spaces with a high titanium carbide concentration, depending on the initial compaction level of these granules;
- the millimetric spaces between the areas with a high titanium carbide concentration, depending on the initial stack of the granules (bulk density);
- the porosity originating from the volume contraction during the reaction between Ti+C for obtaining TiC.

EXAMPLES

In the examples which follow, the following raw materials were used:

- titanium H.C. STARCK, Amperit 155.066, less than 200 mesh,
- graphite carbon GK Kropfmuhl, UF4, >99.5%, less than 15 μm,
- Fe, in the form of HSS M2 Steel, less than 25 μm,
- proportions:
  - Ti+C 100 g Ti-24.5 g C
  - Ti+C+Fe 100 g Ti-24.5 g C-35.2 g Fe Mixing for 15 min in a Lindor mixer, under argon.

The granulation was carried out with a Sahut-Conreur granulator.

For the Ti+C+Fe and Ti+C mixtures, the compactness of the granules was obtained by varying the pressure between the rolls from 10 to $250.10^5$ Pa.

The reinforcement was carried out by placing granules in a metal container, which is then judiciously placed in the mold at the location where the tooth is likely to be reinforced. Then, the steel or the cast iron is cast into the mold.

Example 1

In this example, the aim is to make a tooth, the reinforced areas of which comprise a global volume percentage of TiC of about 42%. For this purpose, a strip is made by compaction to 85% of the theoretical density of a mixture of C and of Ti. After crushing, the granules are sifted so as to obtain a dimension of granules located between 1.4 and 4 mm. A bulk density of the order of 2.1 g/cm$^3$ is obtained (35% of space between the granules+15% of porosity in the granules).

The granules are positioned in the mold at the location of the portion to be reinforced which thus comprises 65% by volume of porous granules. A cast iron with chromium (3% C, 25% Cr) is then cast at about 1500° C. in a non-preheated sand mold. The reaction between the Ti and the C is initiated by the heat of the cast iron. This casting is carried out without any protective atmosphere. After reaction, in the reinforced portion, 65% by volume of areas with a high concentration of about 65% of globular titanium carbide are obtained, i.e. 42% by the global volume of TiC in the reinforced portion of the tooth.

Example 2

In this example, the aim is to make a tooth, the reinforced areas of which comprise a global volume percentage of TiC of about 30%. For this purpose, a strip is made by compaction to 70% of the theoretical density of a mixture of C and of Ti. After crushing, the granules are sifted so as to obtain a dimension of granules located between 1.4 and 4 mm. A bulk density of the order of 1.4 g/cm$^3$ is obtained (45% of space between the granules+30% of porosity in the granules). The granules are positioned in the portion to be reinforced which thus comprises 55% by volume of porous granules. After reaction, in the reinforced portion, 55% by volume of areas with a high concentration of about 53% of globular titanium carbide are obtained, i.e. about 30% by the global volume of TiC in the reinforced portion of the tooth.

Example 3

In this example, the aim is to make a tooth, the reinforced areas of which comprise a global volume percentage of TiC of about 20%. For this purpose, a strip is made by compaction to 60% of the theoretical density of a mixture of C and of Ti. After crushing, the granules are sifted so as to obtain a dimension of granules located between 1 and 6 mm. A bulk density of the order of 1.0 g/cm$^3$ is obtained (55% of space between the granules+40% of porosity in the granules). The granules are positioned in the portion to be reinforced which thus comprises 45% by volume of porous granules. After reaction, in the reinforced portion, 45% by volume of areas concentrated to about 45% of globular titanium carbide are obtained, i.e. 20% by the global volume of TiC in the reinforced portion of the tooth.

Example 4

In this example, it was sought to attenuate the intensity of the reaction between the carbon and the titanium by adding a ferrous alloy as a powder therein. Like in Example 2, the aim is to make a tooth, the reinforced areas of which comprise a global volume percentage of TiC of about 30%. For this purpose, a strip is made by compaction to 85% of the theoretical density of a mixture of 15% C, 63% Ti and 22% Fe by weight. After crushing, the granules are sifted so as to attain a dimension of granules located between 1.4 and 4 mm. A bulk density of the order of 2 g/cm$^3$ is obtained (45% of space between the granules+15% of porosity in the granules). The granules are positioned in the portion to be reinforced which thus comprises 55% by volume of porous granules. After reaction, in the reinforced portion, 55% by volume of areas with a high concentration of about 55% of globular titanium carbide are obtained, i.e. 30% by volume of the global titanium carbide in the reinforced macro-microstructure of the tooth.

The following tables show the numerous possible combinations.

TABLE 1

(Ti + 0.98 C)
Global percentage of TiC obtained in the reinforced macro-microstructure after reaction of Ti + 0.98 C in the reinforced portion of the tooth.

| | | Compaction of the granules (% of the theoretical density which is 3.75 g/cm$^3$) | | | | | | | | |
|---|---|---|---|---|---|---|---|---|---|---|
| | | 55 | 60 | 65 | 70 | 75 | 80 | 85 | 90 | 95 |
| Filling of the | 70 | 29.3 | 31.9 | 34.6 | 37.2 | 39.9 | 42.6 | 45.2 | 47.9 | 50.5 |
| reinforced | 65 | 27.2 | **29.6** | 32.1 | 34.6 | 37.1 | 39.5 | 42.0 | 44.5 | 46.9 |
| portion of the part | 55 | 23.0 | 25.1 | 27.2 | **29.3** | 31.4 | 33.4 | 35.5 | 37.6 | 39.7 |
| (% by volume) | 45 | 18.8 | 20.5 | 22.2 | 23.9 | 25.7 | 27.4 | **29.1** | 30.8 | 32.5 |

This table shows that with a compaction level ranging from 55 to 95% for the strips and therefore the granules, it is possible to perform granule filling levels in the reinforced portion of the tooth ranging from 45% to 70% by volume (ratio between the total volume of the granules and the volume of their confinement). Thus, in order to obtain a global TiC concentration in the reinforced portion of about 29% by volume (in bold characters in the table), it is possible to proceed with different combinations such as for example 60% compaction and 65% filling, or 70% compaction and 55% filling, or further 85% compaction and 45% filling. In order to obtain granule filling levels in the reinforced portion ranging up to 70% by volume, it is mandatory to apply a vibration in order to pack the granules. In this case, the ISO 697 standard for measuring the filling level is no longer applicable and the amount of material in a given volume is measured.

TABLE 2

Relationship between the compaction level, the theoretical density and the TiC percentage obtained after reaction in the granule.

| | Compaction of the granules | | | | | | | | |
|---|---|---|---|---|---|---|---|---|---|
| | 55 | 60 | 65 | 70 | 75 | 80 | 85 | 90 | 95 |
| Density in g/cm$^3$ | 2.06 | 2.25 | 2.44 | 2.63 | 2.81 | 3.00 | 3.19 | 3.38 | 3.56 |
| TiC obtained after reaction (and contraction) in volume % in the granules | 41.8 | 45.6 | 49.4 | 53.2 | 57.0 | 60.8 | 64.6 | 68.4 | 72.2 |

Here, we have represented the density of the granules according to their compaction level and the volume percent of TiC obtained after reaction and therefore contraction of about 24% by volume was inferred therefrom. Granules compacted to 95% of their theoretical density therefore allow to obtain after reaction a concentration of 72.2% by volume of TiC.

TABLE 3

Bulk density of the stack of granules

| | | Compaction | | | | | | | | |
|---|---|---|---|---|---|---|---|---|---|---|
| | | 55 | 60 | 65 | 70 | 75 | 80 | 85 | 90 | 95 |
| Filling of the reinforced portion of the part in volume % | 70 | 1.4 | 1.6 | 1.7 | 1.8 | 2 | 2.1 | 2.2 | 2.4 | 2.5 |
| | 65 | 1.3* | 1.5 | 1.6 | 1.7 | 1.8 | 2.0 | 2.1 | 2.2 | 2.3 |
| | 55 | 1.1 | 1.2 | 1.3 | 1.4 | 1.5 | 1.7 | 1.8 | 1.9 | 2.0 |
| | 45 | 0.9 | 1.0 | 1.1 | 1.2 | 1.3 | 1.4 | 1.4 | 1.5 | 1.6 |

*Bulk density (1.3) = theoretical density (3.75 g/cm$^3$) × 0.65 (filling) × 0.55 (compaction)

In practice, these tables are used as abacuses by the user of this technology, who sets a global TiC percentage to be obtained in the reinforced portion of the tooth and who, depending on this, determines the filling level and the compaction of the granules which he/she will use. The same tables were produced for a mixture of Ti+C+Fe powders.

Ti+0.98 C+Fe

Here, the inventor aimed at a mixture allowing to obtain 15% by volume of iron after reaction. The mixture proportion which was used is:

100 g Ti+24.5 g C+35.2 g Fe

By iron powder it is meant: pure iron or an iron alloy.

Theoretical density of the mixture: 4.25 g/cm$^3$

Volume shrinkage during the reaction: 21%

TABLE 4

Global TiC percentage obtained in the reinforced macro-microstructure after reaction of Ti + 0.98 C + Fe in the reinforced portion of the tooth.

| | | Compaction of the granules (% of the theoretical density which is 4.25 g/cm$^3$) | | | | | | | | |
|---|---|---|---|---|---|---|---|---|---|---|
| | | 55 | 60 | 65 | 70 | 75 | 80 | 85 | 90 | 95 |
| Filling of the reinforced portion of the part (vol. % ) | 70 | **25.9** | 28.2 | 30.6 | 32.9 | 35.5 | 37.6 | 40.0 | 42.3 | 44.7 |
| | 65 | 24.0 | **26.2** | 28.4 | 30.6 | 32.7 | 34.9 | 37.1 | 39.3 | 41.5 |
| | 55 | 20.3 | 22.2 | 24.0 | **25.9** | 27.7 | 29.5 | 31.4 | 33.2 | 35.1 |
| | 45 | 16.6 | 18.1 | 19.6 | 21.2 | 22.7 | 24.2 | **25.7** | 27.2 | 28.7 |

Again, in order to obtain a global TiC concentration in the reinforced portion of about 26% by volume (in bold characters in the table), it is possible to proceed with different combinations such as for example 55% compaction and 70% filling, or 60% compaction and 65% filling, or 70% compaction and 55% filling, or further 85% compaction and 45% filling.

TABLE 5

Relationship between the compaction level, the theoretical density and the TiC percentage, obtained after reaction in the granule while taking into account the presence of iron.

| | Compaction of the granules | | | | | | | | |
|---|---|---|---|---|---|---|---|---|---|
| | 55 | 60 | 65 | 70 | 75 | 80 | 85 | 90 | 95 |
| Density in g/cm$^3$ | 2.34 | 2.55 | 2.76 | 2.98 | 3.19 | 3.40 | 3.61 | 3.83 | 4.04 |
| TiC obtained after reaction (and contraction) in vol. % in the granules | 36.9 | 40.3 | 43.6 | 47.0 | 50.4 | 53.7 | 57.1 | 60.4 | 63.8 |

TABLE 6

Bulk density of the stack of (Ti + C + Fe) granules

| | | Compaction | | | | | | | | |
|---|---|---|---|---|---|---|---|---|---|---|
| | | 55 | 60 | 65 | 70 | 75 | 80 | 85 | 90 | 95 |
| Filling of the reinforced portion of the part in vol. % | 70 | 1.6 | 1.8 | 1.9 | 2.1 | 2.2 | 2.4 | 2.5 | 2.7 | 2.8 |
| | 65 | 1.5* | 1.7 | 1.8 | 1.9 | 2.1 | 2.2 | 2.3 | 2.5 | 2.6 |
| | 55 | 1.3 | 1.4 | 1.5 | 1.6 | 1.8 | 1.9 | 2.0 | 2.1 | 2.2 |
| | 45 | 1.1 | 1.1 | 1.2 | 1.3 | 1.4 | 1.5 | 1.6 | 1.7 | 1.8 |

*Bulk density (1.5) = theoretical density (4.25) × 0.65 (filling) × 0.55 (compaction)

Advantages

The present invention has the following advantages in comparison with the state of the art in general:

Better Resistance to Impacts

With the present method, porous millimetric granules are obtained which are embedded into the infiltration metal alloy. These millimetric granules themselves consist of microscopic particles of TiC with a globular tendency also embedded into the infiltration metal alloy. This system allows to obtain a tooth with a reinforcement area comprising a macrostructure within which there is an identical microstructure at a scale which is about a thousand times smaller.

The fact that the reinforcement area of the tooth comprises small hard globular particles of titanium carbide finely dispersed in a metal matrix surrounding them allows to avoid the formation and propagation of cracks (see FIGS. 4 and 6). One has thus a double dissipative system for cracks.

The cracks generally originate at the most brittle locations, which in this case are the TiC particle or the interface between this particle and the infiltration metal alloy. If a crack originates at the interface or in the micrometric TiC particle, the propagation of this crack is then hindered by the infiltration alloy which surrounds this particle. The toughness of the infiltration alloy is greater than that of the ceramic TiC particle. The crack needs more energy for passing from one particle to another, for crossing the micrometric spaces which exist between the particles.

Maximum Flexibility for the Application Parameters

In addition to the compaction level of the granules, two parameters may be varied, which are the grain size fraction and the shape of the granules, and therefore their bulk density. On the other hand, in a reinforcement technique with inserts, only the compaction level of the latter can be varied within a limited range. As regards the desired shape to be given to the reinforcement, taking into account the design of the tooth and the location where reinforcement is desired, the use of granules allows further possibilities and adaptation.

Advantages as Regards Manufacturing

The use of a stack of porous granules as a reinforcement has certain advantages as regards manufacturing:

less gas emission, less sensitivity to crack, better localization of the reinforcement in the tooth.

The reaction between Ti and C is strongly exothermic. The rise in temperature causes degassing of the reagents, i.e. volatile materials comprised in the reagents ($H_2O$ in carbon, $H_2$, $N_2$ in titanium). The higher the reaction temperature, the more significant is this emission. The granule technique allows to limit the temperature, to limit the gas volume and to more easily discharge the gases and thus limit the gas defects. (see FIG. 7 with an undesirable gas bubble).

Low Sensitivity to Crack During the Manufacturing of the Tooth According to the Invention The expansion coefficient of the TiC reinforcement is lower than that of the ferrous alloy matrix (expansion coefficient of TiC: 7.5 $10^{-6}$/K and of the ferrous alloy: about 12.0 $10^{-6}$/K). This difference in expansion coefficients has the consequence of generating stresses in the material during the solidification phase and also during the heat treatment. If these stresses are too significant, cracks may appear in the part and lead to its reject. In the present invention a small proportion of TiC reinforcement is used (less than 50% by volume), which causes less stresses in the part. Further, the presence of a more ductile matrix between the micrometric globular TiC particles in the alternating areas of low and high concentration allows to better handle possible local stresses.

Excellent Maintenance of the Reinforcement in the Tooth

In the present invention, the frontier between the reinforced portion and the non-reinforced portion of the tooth is not abrupt since there is a continuity of the metal matrix between the reinforced portion and the non-reinforced portion, which allows to protect it against a complete detachment of the reinforcement.

Test Results

Figure 1A:
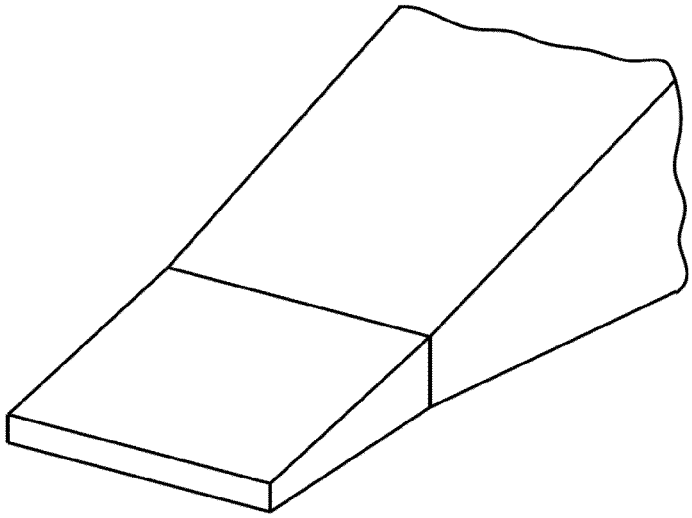
FIGS. 1*a* and 1*b* show a three-dimensional view of teeth without reinforcement according to the state of the art.
Figure 1B:
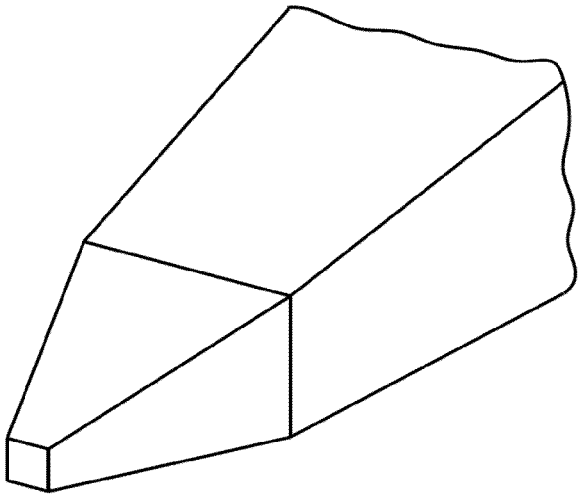
Figure 1C:
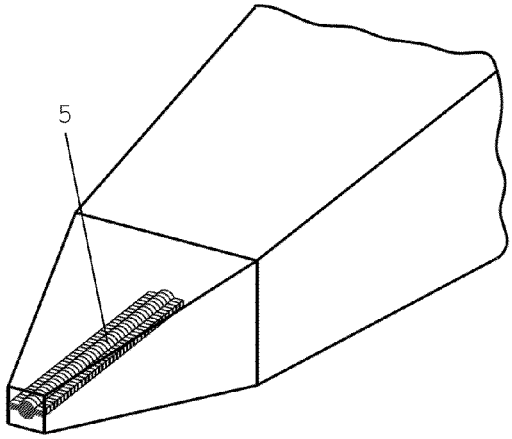
FIGS. 1*c* to 1*h* show a three-dimensional view of teeth with reinforcement according to the invention.
Figure 1D:
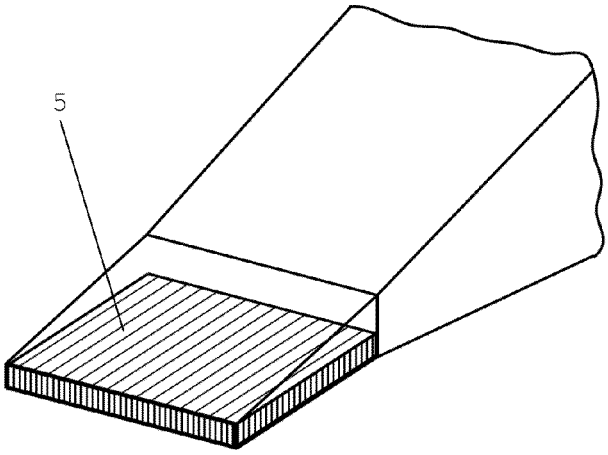
Figure 1E:
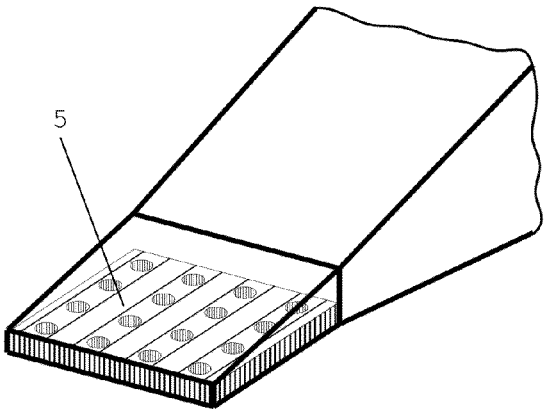
Figure 1F:
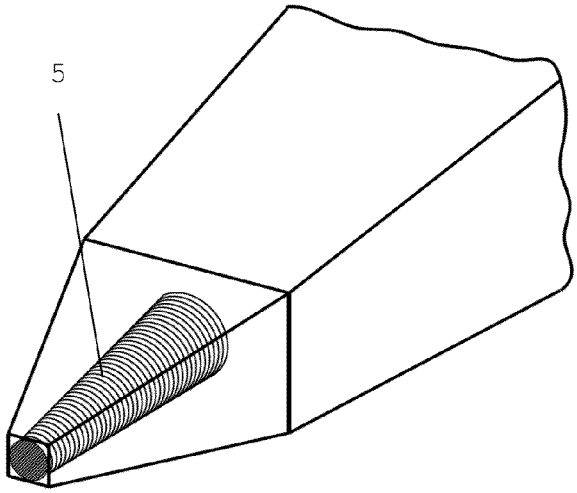
Figure 1G:
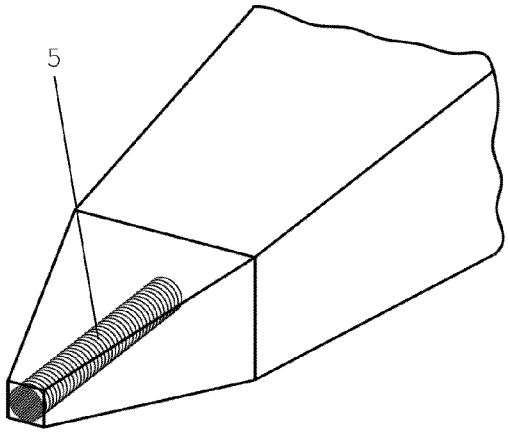
Figure 1H:
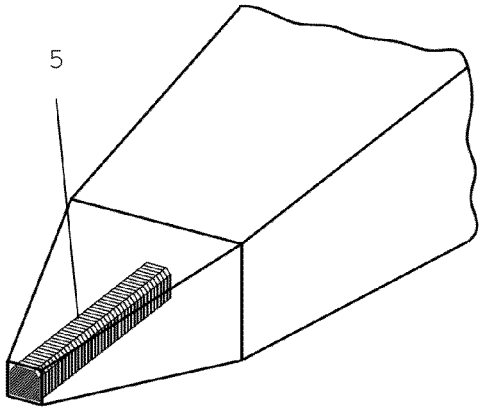
Figure 2:
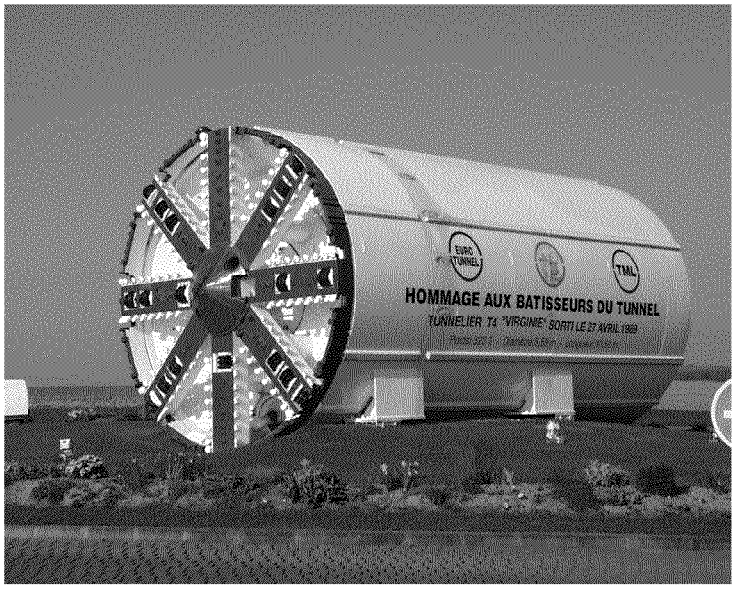
FIG. 2 shows illustrative examples of tools on which the teeth according to the invention are mounted. Excavation and drilling tools.
Figure 2:
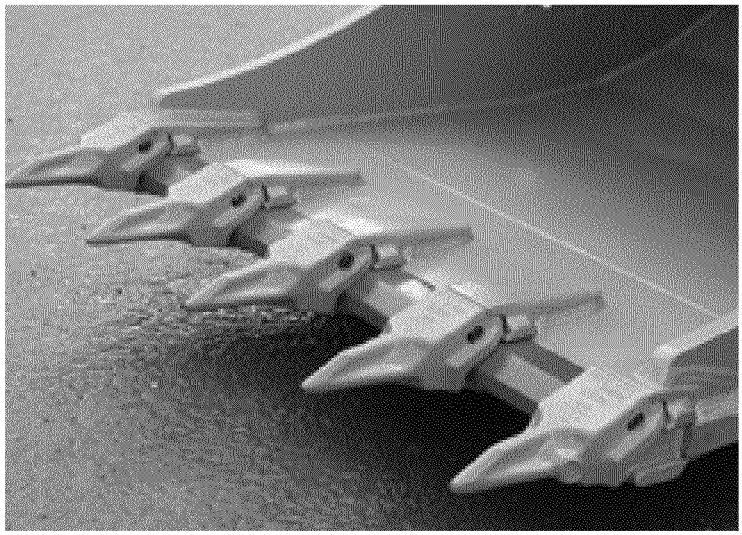

The advantages of the tooth according to the present invention in comparison with non-composite teeth are an improved resistance to wear in the order of 300%. In more detail, and depending on the test conditions (sludging), it was possible to observe the following performances (expressed in lifetime of the tooth for a given work volume) for products made according to the invention (reinforcement of the FIG. 1*f* type, globally comprising a percentage by volume of TiC of 30% vol—example 2), in comparison with identical teeth made from hardened steel.

hard limestone: 2.5 times;

mixture of compacted hard clay, sand and gravel: 2.9 times;

mixture of sand and hard clay: 3.2 times;

mixture of shale and sand: 3.4 times.

Overall, the lifetime of the type if tooth (see FIG. 1*f*) with 30% by volume of TiC in the reinforced portion is 2.5 to 3.4 times longer in comparison with an identical tooth made from hardened steel.

The invention claimed is:

1. A composite tooth for working the ground or rocks, said tooth comprising a ferrous alloy at least partially reinforced (5) with titanium carbide according to a defined geometry, wherein said reinforced portion (5) comprises an alternating macro-microstructure of millimetric areas (1) concentrated with micrometric globular particles of titanium carbide (4) separated by millimetric areas (2) essentially free of micrometric globular particles of titanium carbide (4), said areas concentrated with micrometric globular particles of titanium carbide (4) forming a microstructure in which the micrometric interstices (3) between said globular particles (4) are also filled by said ferrous alloy.

2. The tooth according to claim 1, wherein said millimetric concentrated areas have a concentration of micrometric globular particles of titanium carbide (4) greater than 36.9% by volume.

3. The tooth according to claim 1, wherein said reinforced portion has a global titanium carbide content between 16.6 and 50.5% by volume.

4. The tooth according to claim 1, wherein the micrometric globular particles of titanium carbide (4) have a size of less than 50 μm.

5. The tooth according to claim 1, wherein the major portion of the micrometric globular particles of titanium carbide (4) has a size of less than 20 μm.

6. The tooth according to claim 1, wherein said areas concentrated with globular particles of titanium carbide (1) comprise 36.9 to 72.2% by volume of titanium carbide.

7. The tooth according to claim 1, wherein said areas concentrated with titanium carbide (1) have a dimension varying from 1 to 12 mm.

8. The tooth according to claim 1, wherein said areas concentrated in titanium carbide (1) have a dimension varying from 1 to 6 mm.

9. The tooth according to claim 1, wherein said areas concentrated in titanium carbide (1) have a dimension varying from 1.4 to 4 mm.

10. A method for manufacturing by casting a composite tooth according to claim 1, comprising the following steps:

providing a mold comprising the imprint of the tooth with a predefined reinforcement geometry;

introducing, into the portion of the imprint of the tooth intended to form the reinforced portion (5), a mixture of compacted powders comprising carbon and titanium in the form of millimetric granules precursor of titanium carbide;

casting a ferrous alloy into the mold, the heat of said casting triggering an exothermic self-propagating high temperature synthesis (SHS) of titanium carbide within said precursor granules;

forming, within the reinforced portion (5) of the tooth, an alternating macro-microstructure of millimetric areas concentrated (1) with micrometric globular particles of titanium carbide (4) at the location of said precursor granules, said areas being separated from each other by millimetric areas (2) essentially free of micrometric globular particles of titanium carbide (4), said globular particles (4) being also separated within said millimetric areas concentrated (1) with titanium carbide by micrometric interstices (3);

infiltration of the millimetric (2) and micrometric (3) interstices by said high temperature cast ferrous alloy, following the formation of microscopic globular particles of titanium carbide (4).

11. The manufacturing method according to claim 10, wherein the mixture of compacted powders of titanium and carbon comprises a powder of a ferrous alloy.

12. The manufacturing method according to claim 10, wherein said carbon is graphite.

13. The tooth obtained according to claim 10.

* * * * *